US011407548B2

(12) United States Patent
Graham et al.

(10) Patent No.: US 11,407,548 B2
(45) Date of Patent: Aug. 9, 2022

(54) HIGH SPEED LABELER FOR LARGE PRODUCE ITEMS

(71) Applicant: Sinclair Systems International, LLC, Fresno, CA (US)

(72) Inventors: Justin Graham, Clovis, CA (US); Samuel Aaron Greer, Friant, CA (US); Russell Alan Jensen, Fresno, CA (US); Kevin Guadagnini, Coarsegold, CA (US); Jeremy Benjamin Isch, Fresno, CA (US)

(73) Assignee: Sinclair Systems International, LLC, Fresno, CA (US)

( * ) Notice: Subject to any disclaimer, the term of this patent is extended or adjusted under 35 U.S.C. 154(b) by 155 days.

(21) Appl. No.: 16/873,274

(22) Filed: Mar. 10, 2020

(65) Prior Publication Data

US 2020/0299020 A1 Sep. 24, 2020

Related U.S. Application Data

(60) Provisional application No. 62/919,671, filed on Mar. 22, 2019.

(51) Int. Cl.

| | |
|---|---|
| ***B65C 9/02*** | (2006.01) |
| ***B65C 9/18*** | (2006.01) |
| ***B65C 9/30*** | (2006.01) |
| ***B65C 3/00*** | (2006.01) |

(52) U.S. Cl.

CPC ..... *B65C 9/02* (2013.01); *B65C 3/00* (2013.01); *B65C 9/1869* (2013.01); *B65C 9/1892* (2013.01); *B65C 9/30* (2013.01)

(58) Field of Classification Search

CPC ..... B65C 9/1876; B65C 9/1884; B65C 9/02
See application file for complete search history.

(56) References Cited

U.S. PATENT DOCUMENTS

| | | | | |
|---|---|---|---|---|
| 2,053,022 | A | 1/1935 | Cordswandt et al. | |
| 2,787,104 | A | 8/1953 | Carter | |
| 5,868,893 | A | 2/1999 | Kipper et al. | |
| 6,910,820 | B2 * | 6/2005 | Baker | B41J 13/02 400/611 |
| 8,157,946 | B2 * | 4/2012 | Arrington | B65C 9/1876 156/249 |
| 2007/0181737 | A1 * | 8/2007 | Yamashita | B65H 20/32 242/563 |
| 2016/0023370 | A1 | 1/2016 | Muller | |
| 2017/0043897 | A1 | 2/2017 | Mooneyham et al. | |

OTHER PUBLICATIONS

Patent Cooperation Treaty, International Search Report and Written Opinion of the International Searching Authority, dated Jul. 16, 2020.

* cited by examiner

*Primary Examiner* — Philip C Tucker
*Assistant Examiner* — John Blades
(74) *Attorney, Agent, or Firm* — Jones Day

(57) ABSTRACT

An automatic, high speed labeling machine is provided for applying individual labels to large and variable size produce items. The label strips used are much larger and heavier than known label strips used for small produce such as apples and pears. The increased weight causes label strip overrun when the labeler is paused and also causes slippage of the label strip. A label strip deflector is provided which causes the larger and heavier label strip to fold back on itself rather than to overrun and foul the application of labels. The drive rollers are modified to eliminate slippage of the heavier label strip.

11 Claims, 18 Drawing Sheets

HIGH SPEED LABELER FOR LARGE PRODUCE ITEMS

CROSS REFERENCE TO RELATED APPLICATION

This application claims the benefit of and priority from U.S. provisional application Ser. No. 62/919,671 filed Mar. 22, 2019.

BACKGROUND

The present invention pertains generally to the automatic, high speed labeling of large variable size produce items, such as watermelons, squash, cantaloupe, pumpkins and other large produce.

The prior art has two systems for labeling such large produce items, which typically have a large variation in size. For example, watermelons may vary from 5 to 30 pounds in size, complicating the design of any automatic labeling system.

The first prior art system known to applicants is hand labeling, which is relatively slow, labor intensive and expensive. A labor shortage at harvest time can be a disaster.

A second prior art system is an automatic labeler by Cheetah Systems LLC, which is a "stand alone device," and must have its vertical height set a fixed distance above a conveyor for a given run of large produce. The result is that a high percentage of smaller produce items fail to be labeled, which is commercially unacceptable.

There has been a need for an efficient high speed, automatic labeler of large produce items with variable sizes between 5 and 30 pounds for 20 years or more.

In addition to the problem of significant size variation in such large produce items, customers demand significantly larger size labels, typically 60 mm and preferably 81 mm in width, and approximately the same in length. Typical prior art automatic labelers for small produce items apply labels having a width and length of approximately 29 mm. The larger labels demanded by customers are roughly seven times larger than prior art labels for apples and pears. The preferred labels 81 mm in length and width have roughly 7 times the momentum and inertia of labels 29 mm in length and width. The carrier strip for the larger labels also increases the momentum and inertia of the label strip.

There are two primary problems that must be overcome to meet the stated needs.

First, to overcome the problem of the huge variation in size between 5 pound and 30 pound produce, expandable bellows known in the art can be readily modified to expand a sufficient distance to overcome this problem.

Secondly, we have encountered significantly more difficult problems in dealing with and controlling the substantially greater weight, inertia and momentum of the larger label strip operating at high speed. Operational speeds of 500 bellow indexes per minute and label strip speed greater than 30 meters/minute are required to label 500 large items of produce per minute; those speeds are achieved with the present invention. The large labels preferred by customers are roughly 7 times larger than prior art labels for apples and pears. This is an increase in weight, inertia and momentum of over 7 times that of known labels for apples and pears. The label carrier strip must also be significantly heavier than those used for apples and pears, resulting in an estimated overall increase in weight, inertia and momentum of the preferred 81 mm width label strip (including labels and carrier strip) of roughly 10 times that of the prior art. The estimate increase in weight, inertia and momentum of a 60 mm wide label strip is approximately 6 times as great as the prior art.

This extreme increase in weight of the label strip causes a variety of significant problems.

Chief among the problems caused by the estimated sixfold to tenfold increase in weight is the difficulty in controlling the increased inertia and momentum of the larger, fast moving label strip and the rotating cassette reel on which the label strip is carried. An example of the "momentum and inertia" problem occurs whenever the much larger label strip in operation must be paused periodically and frequently (typically dozens of times per day) for a variety of reasons. The technique known in the art for stopping a label strip with known small labels for apples and pears has been to suddenly stop the driven scallop wheel that propels the label strip. The relatively small, lightweight label strip unwinds slightly and stops without consequence. However, with the newer and much heavier label strip, when the driven scallop wheel is suddenly stopped, the cassette reel holding the label strip in a detachable label cassette continues to unwind because of the much greater momentum of the label strip and reel. The unwinding of the label strip into the label transfer area fouls the labeling mechanism, which is totally unacceptable.

A complicating factor in trying to solve the unacceptable unwinding of the label strip after sudden stops or pauses is that it is important to avoid having to design a complex braking mechanism for suddenly stopping the rotation of the label reel in the detachable cassette. Such a braking mechanism would be costly and difficult to design.

A further difficult problem posed by the significant increase in momentum of the label strip is slippage of the label strip as it is transported through a system of drive, nip and tensioning rollers. Even small amounts of slippage can throw the label strip out of synchronization with the rotary bellows and the produce items. This in turn causes failure to apply labels to the bellows and/or produce items and resulting downtime in resynchronizing the label strip and relabeling the produce items that failed to be labeled.

The present invention overcomes the above problems, and is capable of 500 bellow indexes per minute, label strip speeds in excess of 30 meters per minute and a successful application rate of 95%.

SUMMARY OF THE INVENTION

As noted above, the use of rotary, expandable bellows with increased expandability for use on produce items with large size variation has been accomplished with relative ease compared to overcoming the problems in dealing with the much heavier and larger label strips.

With respect to controlling the significant increase of label strip momentum, a novel approach has been found to allow a sudden pause or stop in labeling without the label strip unwinding and overrunning to the extent to foul the application of labels. The prior art achieved a pause by simply stopping the drive (or scallop) wheel, and the relatively small momentum of the much smaller label strip allowed the label strip to come to a stop without consequence. The present invention avoids the unacceptable unwinding of the label strip without having to add a complex and robust braking mechanism. Rather, a label strip deflection plate has been developed which causes the label strip to fold back on itself as it partially unwinds in a controlled manner before stopping without fouling the labeling mechanism.

The most preferred embodiment of the invention includes a label strip having a width greater than 60 mm and a speed of greater than 30 meters per minute. Other embodiments of the invention include label strips having widths less than 60 mm and speeds either less or greater than 30 meters per minute in which the label overrun interferes with the application of labels. Any combination of label strip width and speed that produces sufficient momentum to cause sufficient label strip overrun to foul the application of labels when the labeler is paused is within the scope of the invention.

The problem of slippage of the new label strip has been resolved by several significant changes to the design and positioning of the nip roller and tensioning roller relative to the driven scallop wheel.

The prior art placement and design of the nip roller and tensioning roller when utilized with the new and much heavier label strip resulted in a relatively small amount of frictional engagement between the larger and heavier label strip and the driven scallop wheel, as describer further in detail below. The design and placement of the nip roller and tensioning roller in the present invention achieves a constant frictional engagement of the label strip with the driven scallop wheel of approximately a 270 degree arc, a substantial increase in the amount of such frictional engagement, which has eliminated of this particular slippage problem.

The prior art tensioning roller uses a cantilevered support arm which tends to allow slippage of the heavier label strip. The tensioning roller support arm has been improved by providing support arms on both ends of the tension roller, effectively eliminating this source of slippage.

The prior art tensioning roller with the heavier label strip would move to a lowermost position wherein the label strip would be pinched by contacting a stop, resulting in slippage. The new tension roller is prevented from pinching the label strip at its lowermost position.

Other improvements are described and shown below.

The primary object of the invention is to provide an automatic system for high speed labeling of large produce items, typically having a weight of between 5 and 30 pounds.

Other objects and advantages will become apparent from the following description and drawings.

DETAILED DESCRIPTION OF THE DRAWINGS

Figure 1:
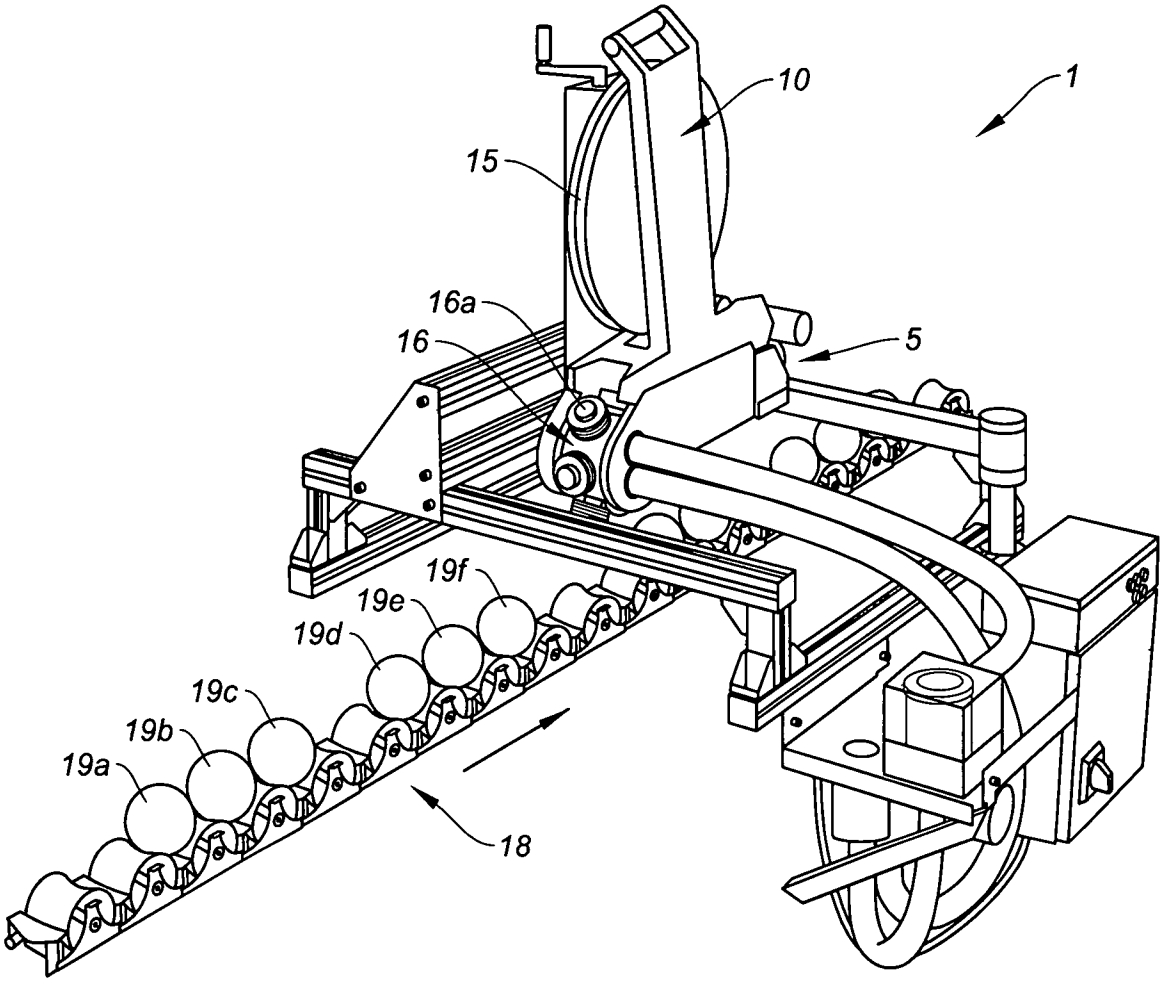
FIG. 1 (Prior Art)
FIG. 1 shows a prior art high speed labeler of small produce items.

FIG. 1 is a perspective view of a prior art high speed, automatic labeling machine 1 used for labeling small produce items such as apples and pears shown as items 19*a*-19*f*. A label applicator 5 carries a detachable label cassette 10. A label strip 15 is carried on a reel (not visible in FIG. 1) at the center of label cassette 10. An indexable rotary head 16 carries a plurality of bellows as is known in the art. A conveyor 18 carries produce items 19*a*-19*f* beneath rotary head 16. Sensing means known in the art (not shown for clarity) detects the presence of a produce item and then applicator 5 dispenses an individual label "sticky side up" onto one of the bellows such as 16*a*. It is significant to note that when an empty space or empty spaces are detected on conveyor 18, the applicator is paused until a produce item is detected. As noted above, such pauses of applicator 5 do not cause a problem when small labels are applied to small produce items such as apples and pears. The label strip 15 unwinds slightly, but does not unwind sufficiently to interfere with labeling.

The prior art labeler shown in FIG. 1 is more fully described in U.S. Pat. Nos. 4,217,164; 4,303,461; 4,454,180 and 4,547,252, which are incorporated herein by reference. The labeler shown in FIG. 1 is also commercially available from Sinclair Systems International, 3115 South Willow Avenue, Fresno, Calif. 93725.

Figure 2A:
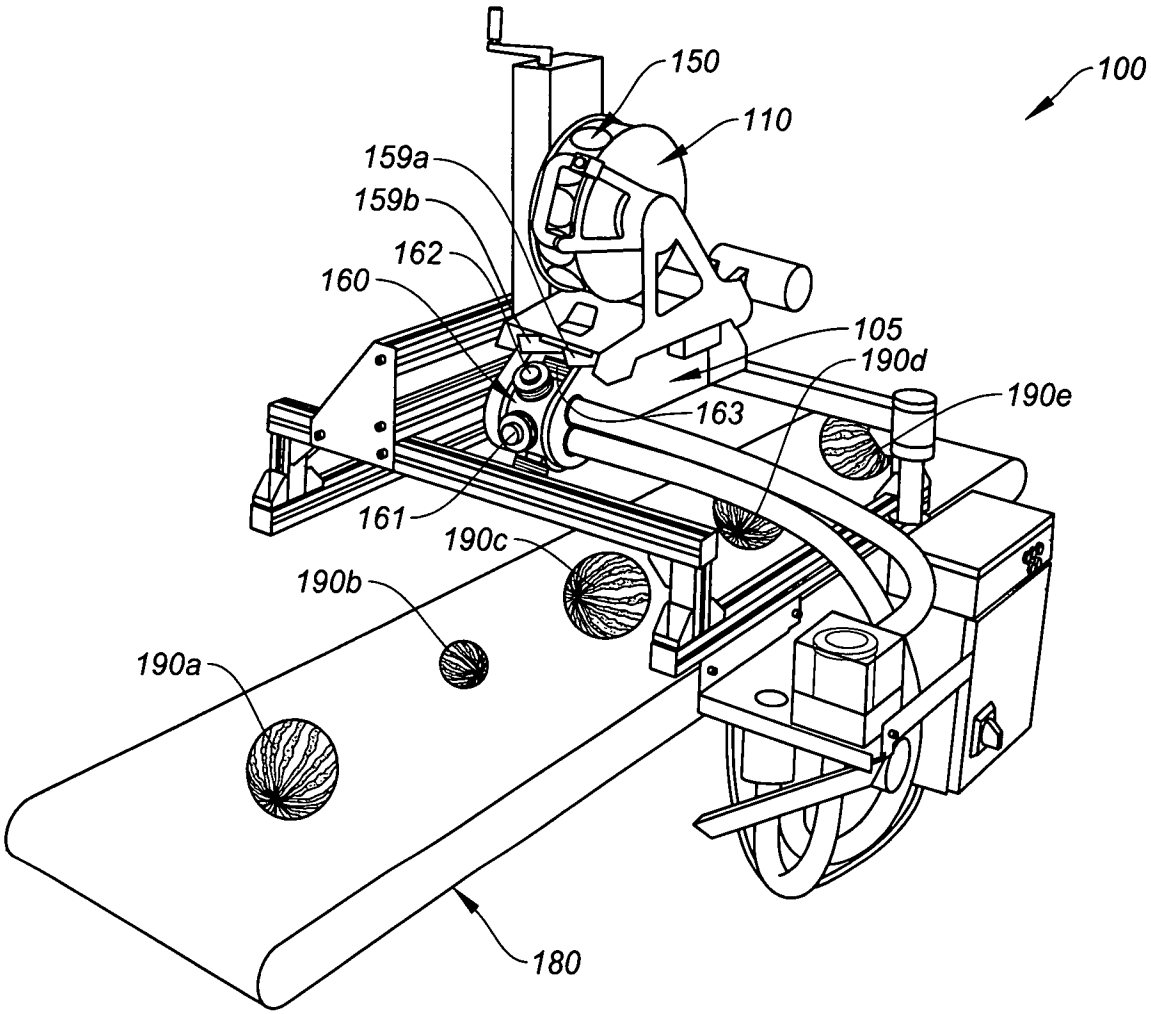
FIG. 2A shows the improved labeler for large produce items.

FIG. 2A is a perspective view of the improved automatic, high speed labeling machine 100 of the present invention. It is capable of labeling large, variable size produce items 190*a*-190*e* weighing between 5 and 30 pounds. Item 190*b* is significantly smaller than the other items shown and may weigh 5 pounds and the other items may weigh up to 30 pounds.

Label applicator 105 carries an indexable rotary head 160 which carries a plurality of expandable bellows, of which two bellows 161, 162 are fully visible in FIG. 2. An elongated label strip 150 is carried on a reel 151 (not visible in FIG. 2) in detachable label cassette 110. The label strip 150 is drawn through applicator 105 as described below to a label transfer point 159 (FIG. 8), which is hereby defined as the region between V-shaped strip edges 159*a* and 159*b*. At label transfer point 159, an individual label (not shown for clarity) is stripped from the label carrier strip by V-shaped label stripping edges 159*a* and 159*b* and transferred "sticky side up" onto the tip of a single expandable bellow 163, partially visible in FIG. 2. That individual label is carried by bellow 163, which bellow expands and applies that label to an individual produce item, such as shown on items 190*c*-190*e*, as known in the art. Conveyor 180 delivers produce items at speeds in excess of 30 meters per minute.

Figure 2B:
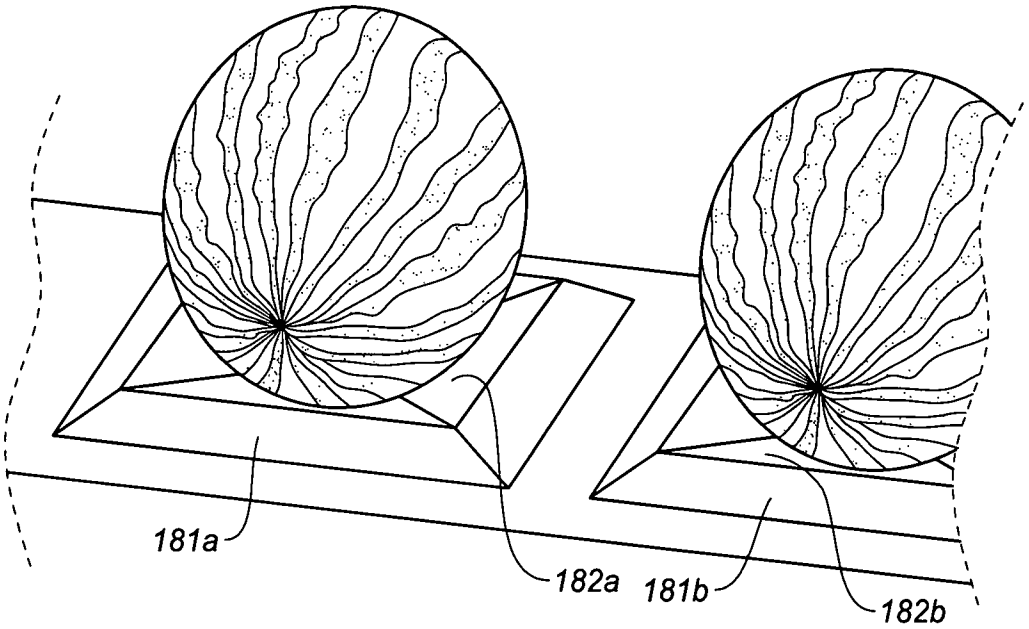
FIG. 2B shown a stabilizer for the large produce items on the conveyor.

FIG. 2B illustrates two of a series of stabilizers 181*a* and 181*b* which are carried on the surface of conveyor 180 to stabilize each of the produce items 190*a*-190*e* shown in FIG. 2A. Conveyor 180 carries a continuous stream of such stabilizers or cradles. Each stabilizer as shown in FIG. 2B has a rectangular shape with 4 downwardly sloping surfaces such as 182*a* and 182*b* to prevent the produce items from moving. Other stabilizer designs may be utilized.

Figure 3:
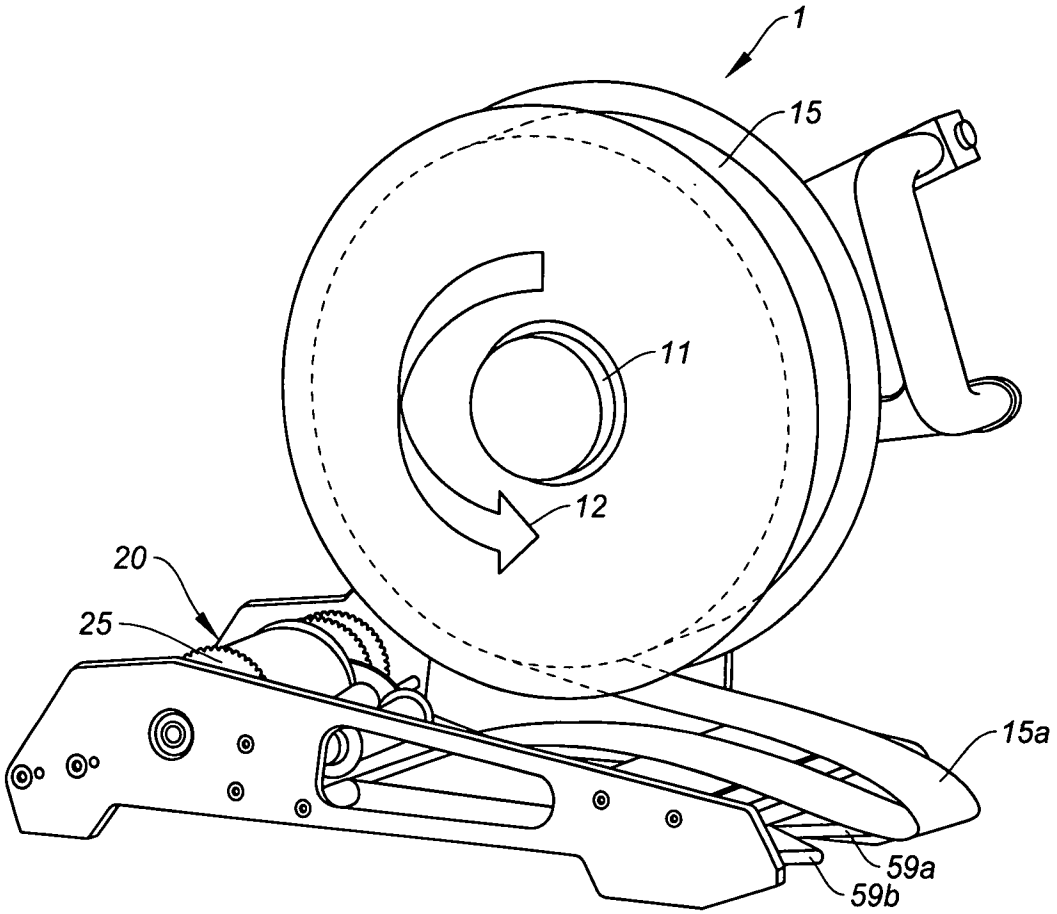
FIG. 3 (Prior Art)
FIG. 3 illustrates the problem of label strip overrun when using a larger, heavier label strip with a prior art drive.

FIG. 3 is a perspective view of that portion of prior art labeler 1 in FIG. 1 which includes the detachable label cassette 10, label strip 15, label strip drive 20 (see FIG. 5A), and V-shaped label strip edges 59*a* and 59*b*.

FIG. 3 illustrates the most significant problem encountered in using the much larger, heavier and fast moving labels having a preferred width greater than 60 mm as described above. When the label applicator does not sense an incoming produce item, drive means 20 is paused by stopping the driven scallop wheel 25. However, the label strip 15 unwinds as cassette reel 11 continues to rotate and unwinds in a counterclockwise direction as shown by arrow 12. This unwinding causes portion 15*a* of label strip 15 to overrun and extend into the region of the label transfer point between strip edges 59*a* and 59*b*. At this location, the overrun portion 15*a* of label strip 15 may adhere to the sticky side of a label (not shown in FIG. 3) being transferred or may otherwise foul the label application process. This problem is unacceptable, since the labeler is paused several dozens of times each day. The most common reason for pausing is the produce sensor detects the presence of empty spaces on the conveyor, which occurs frequently.

Figure 4:
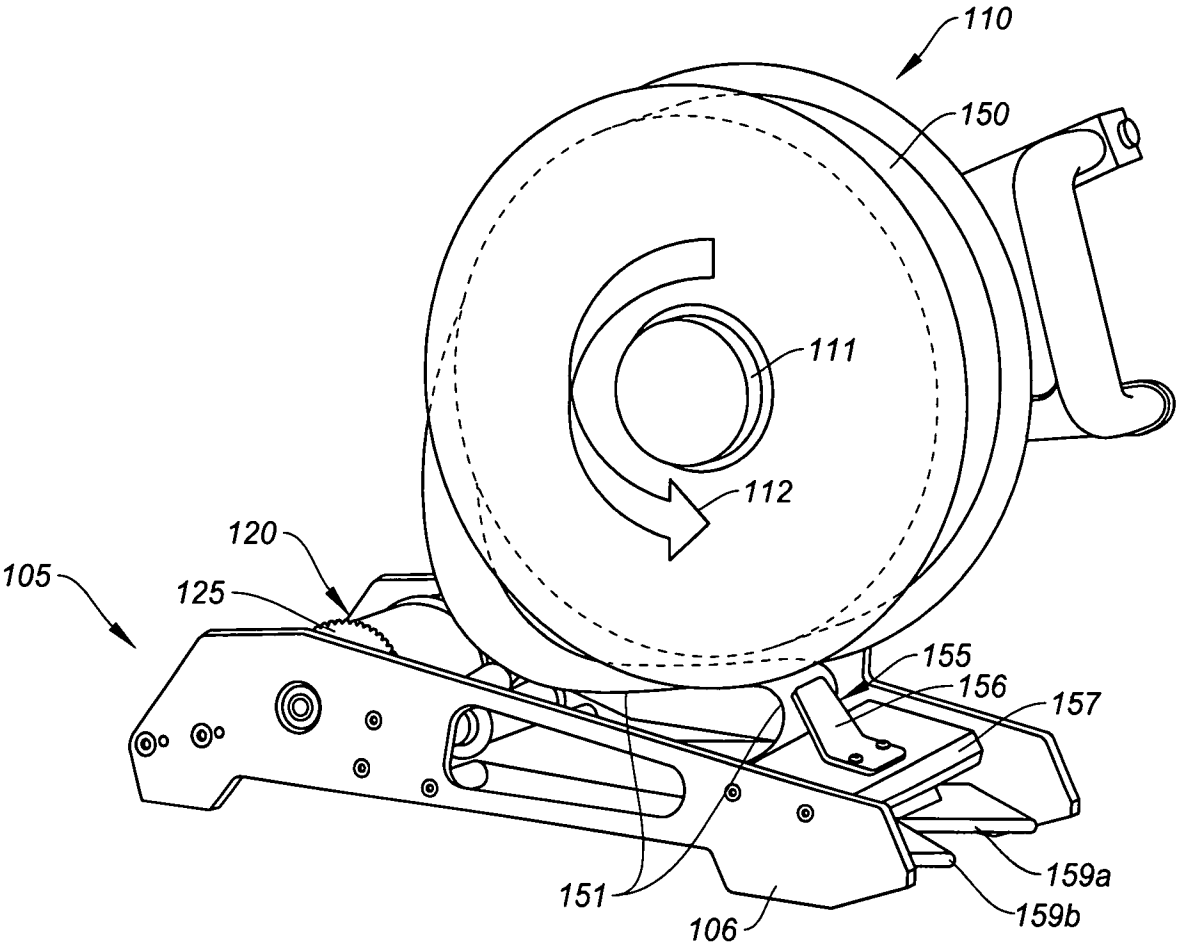
FIG. 4 illustrates how the novel label strip deflector prevents label strip overruns.

FIG. 4 is a perspective view showing how the label strip overrun problem of FIG. 3 has been solved. As the heavier label strip 150 and cassette reel 111 continue to rotate and unwind when drive means 120 is paused, the overrun portion 151 of label strip 150 encounters label strip deflection means 155.

Label strip deflection means 155 as shown in FIG. 4 is a fixed plate 156 that is carried by label applicator 105 and positioned above the pathway 152 (see FIGS. 6A and 6B) of labeling strip 150 and is preferably inclined upwardly in a direction opposite to the direction of travel of label strip 150. Plate 156 is positioned laterally between drive means 120 and label transfer point 159 as shown best in FIG. 4. Plate 156 is carried by support 157 attached to the frame 106 of applicator 105. The effect of plate 156 is to cause label strip overrun portion 151 to stop advancing toward the label transfer point 159, which is the region between label stripping edges 159*a* and 159*b* (shown best in FIG. 9) and to fold back on itself as shown in FIG. 4 to prevent any part of label strip 150 from overrunning sufficiently to foul or interfere with the label application process. When the pause of drive means 120 is ended, for example when a produce item ready for labelling is sensed, the folded portion 151 of label strip 150 is drawn forward by drive means 120 and labelling resumes without any loss of synchronization between the label strip, the bellows and the produce items being conveyed.

This solution to the overrun problem has been accomplished without having to develop a complex and expensive braking mechanism for suddenly stopping the unwinding of cassette reel 111 and label strip 150 when the applicator 105 is paused.

As noted above, the preferred embodiment of the invention uses a label strip having a width greater than 60 mm and speeds greater than 30 meters per minute, but other combinations of label strip width and speeds which cause unacceptable overrun are within the scope of the invention.

FIGS. 5A, 5B and 6A, 6B are sketches, not to scale, and slightly exaggerated to illustrate the problem of slippage of the heavier and much larger label strip and how this problem has been solved.

Figure 5A:
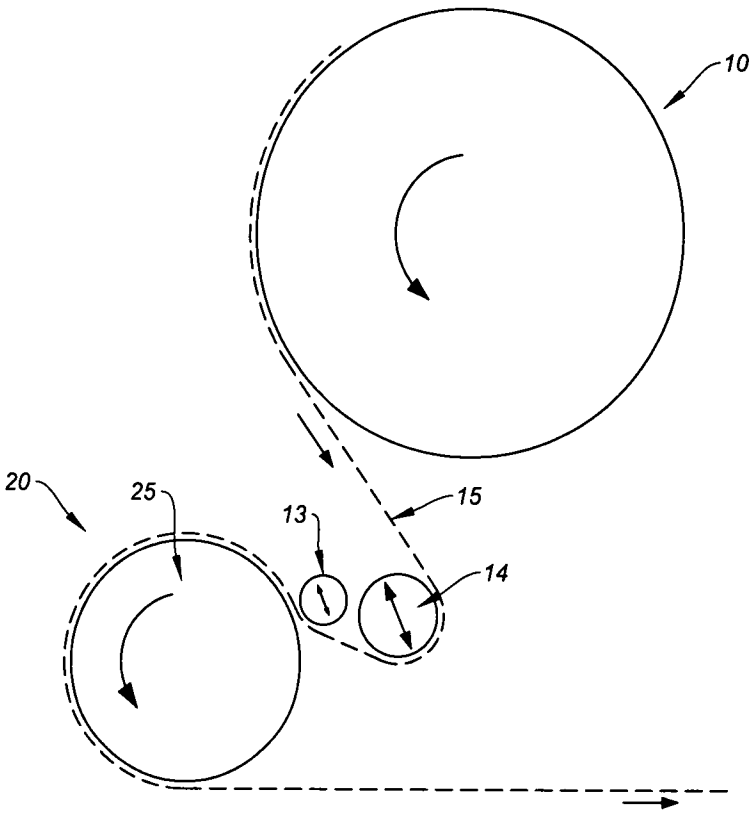
FIG. 5A (Prior Art)
FIGS. 5A-5B are sketches, not to scale, illustrating the problem of using prior art nip and tension rollers with a much heavier and wider label strip.
Figure 5B:
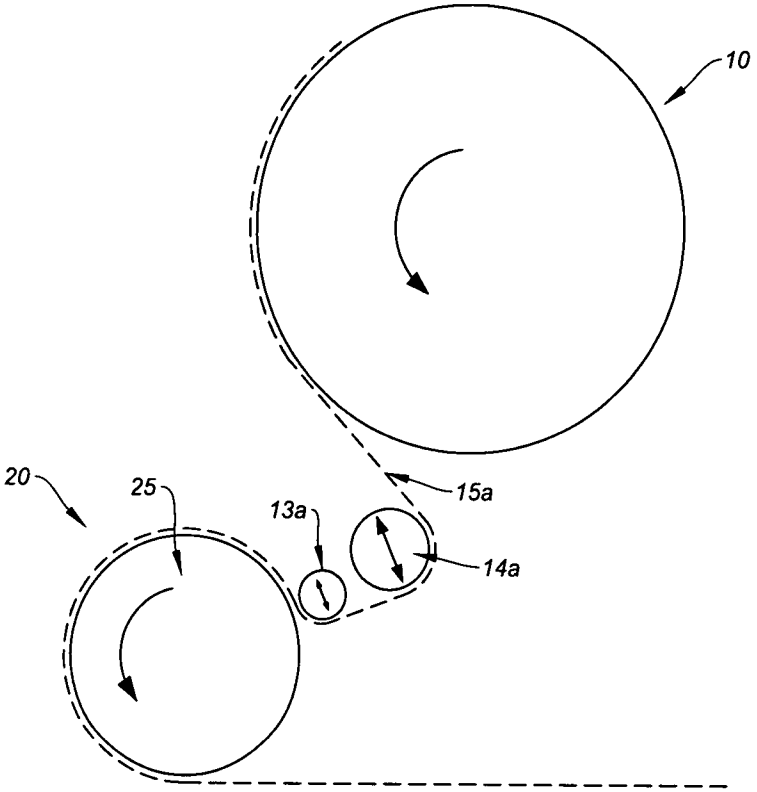
FIG. 5B (Prior Art)

FIGS. 5A and 5B illustrate the prior art pathway of label strip 15 as it is pulled off cassette 10 by drive 20. Prior art drive 20 includes a driven scallop wheel 25, nip roller 13 and tension roller 14. Nip roller 13 and tension roller are carried in cantilever fashion by a common support bar (not shown in FIG. 5A for clarity). In FIG. 5A, the nip roller 13 and tension roller 14 are shown in their lowermost positions. As driven scallop wheel 25 rotates, it draws label strip 15 off cassette 10, around tension roller 14 and nip roller 13 as shown in FIG. 5A. Nip roller 13 and tension roller 14 move together between the positions shown in FIG. 5A as 13 and 14 to the positions shown as 13*a* and 14*a* in FIG. 5B. In the upper position of nip roller 13*a* in FIG. 5B, there is approximately a 180° arc of frictional engagement between label strip 15 and the surface of driven scallop wheel 25. As nip roller 13 moves between the two positions shown in FIGS. 5A and 5B, the much larger and heavier new label strip would slip relative to scallop wheel 25, causing an unacceptable loss of synchronization between the label strip, rotary bellow and moving produce item (not shown for clarity).

Figure 6A:
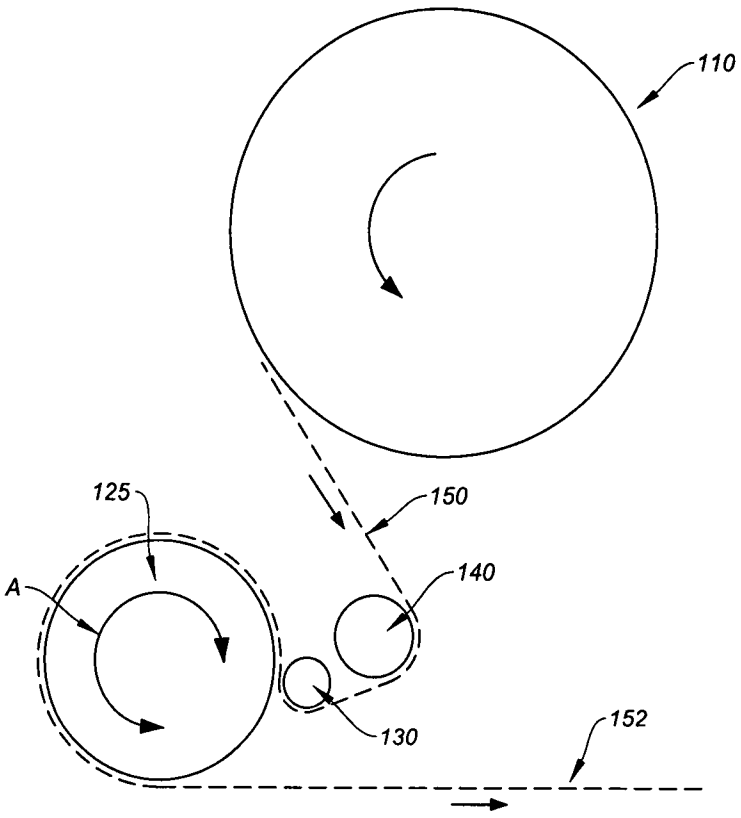
FIGS. 6A-6B illustrate the new positioning and support of the nip and tension rollers to reduce slippage of the heavier label strip.
Figure 6B:
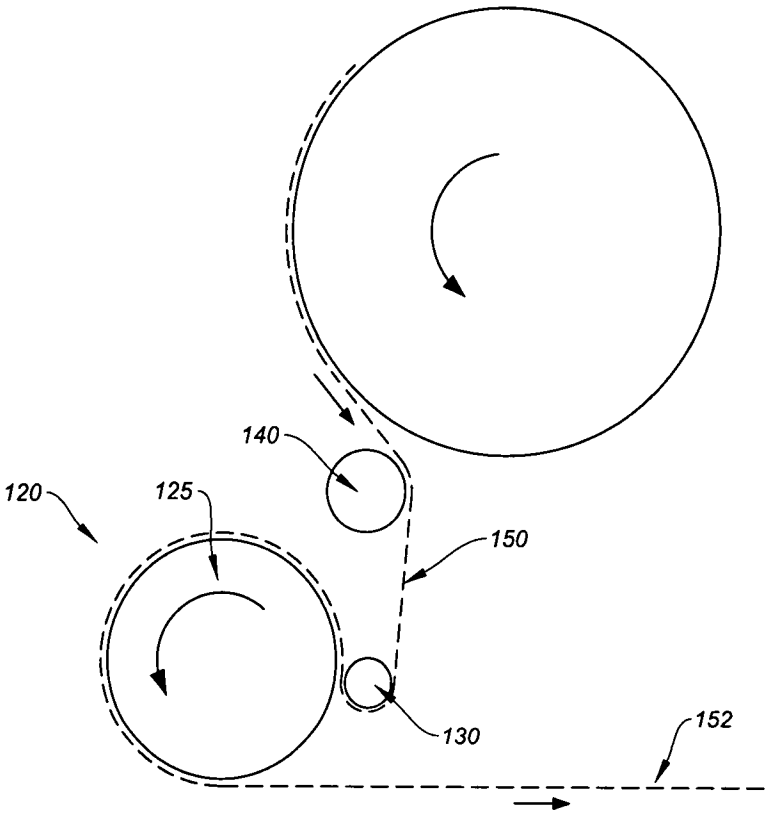

FIGS. 6A and 6B illustrate the solution to the problem of label strip slippage shown in FIGS. 5A and 5B. The nip roller 130 and tension roller 140 are supported separately from each other, as shown in detail below. Nip roller 130 is fixed (rather than oscillating between the positions shown in FIGS. 5A and 5B) and mounted to provide a fixed arc A of frictional engagement of 270° between label strip 150 and the surface of scallop wheel 125. The tension roller 140 moves as necessary between its lowermost position shown in FIG. 6A to its uppermost position shown in FIG. 6B. The fixed 270 arc A of degree frictional engagement between label strip and nip roller has eliminated this slippage problem.

FIGS. 6A and 6B also show the pathway 152 of label strip 150 (a two part or split tape known in the art) as it passes beneath scallop wheel 125. Label strip 150 then passes below label stripping edges 159*a* and 159*b* (not shown in FIG. 6B for clarity) and is then drawn upwardly to transfer labels, as is known in the art.

Figure 7A:
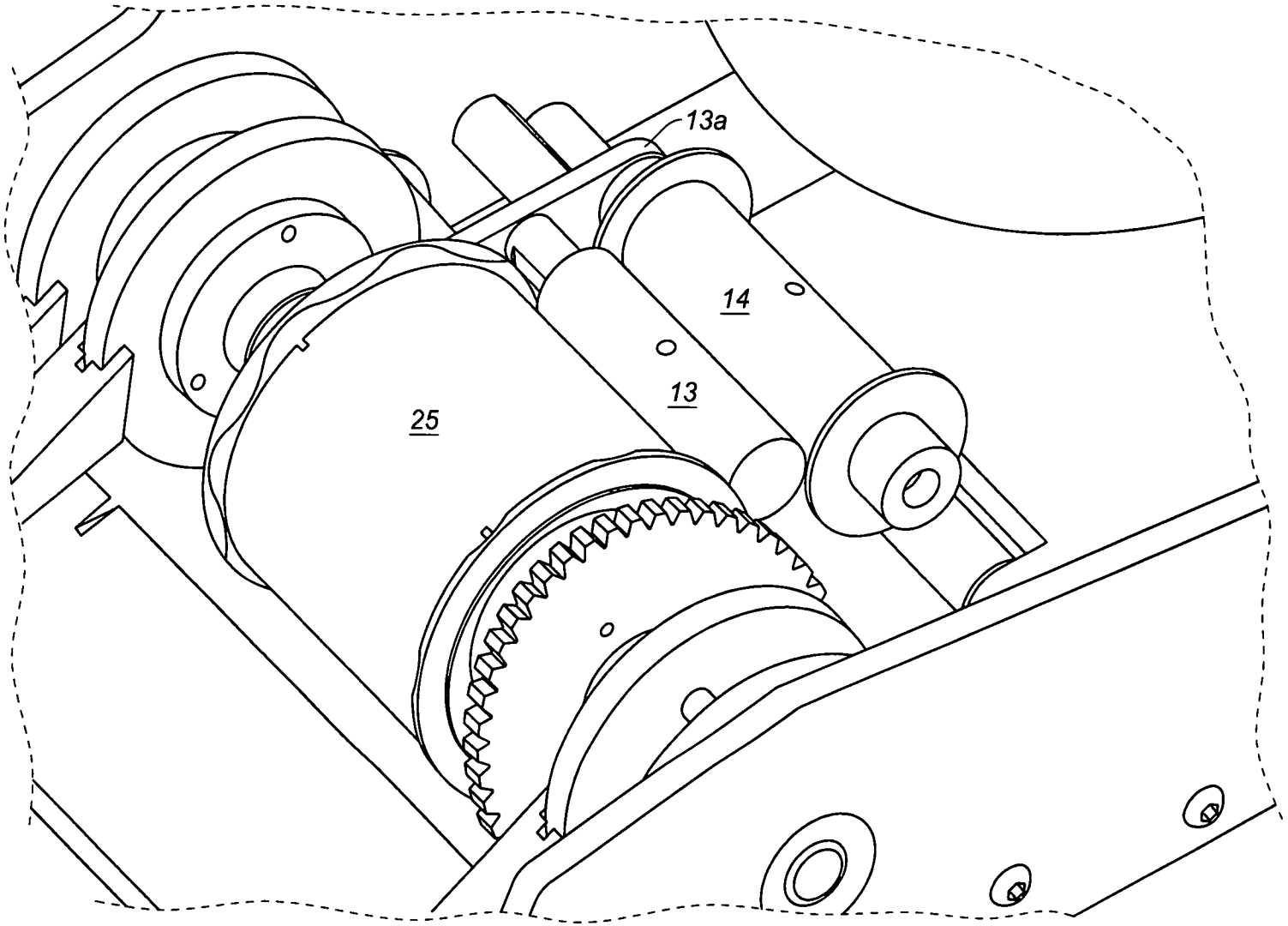
FIG. 7A (Prior Art)
FIG. 7A illustrates the prior art cantilevered mounting of the nip and tension rollers.

FIG. 7A is a perspective view showing prior art driven scallop wheel 25 and how the prior art nip roller 13 and tension roller 14 were carried in cantilevered fashion from a common support arm 13*a*. The much heavier new label strip caused enough flexing of rollers 13 and 14 relative to support arm 13*a* to cause slippage of label strip 15 (not shown for clarity in FIG. 7A).

Figure 7B:
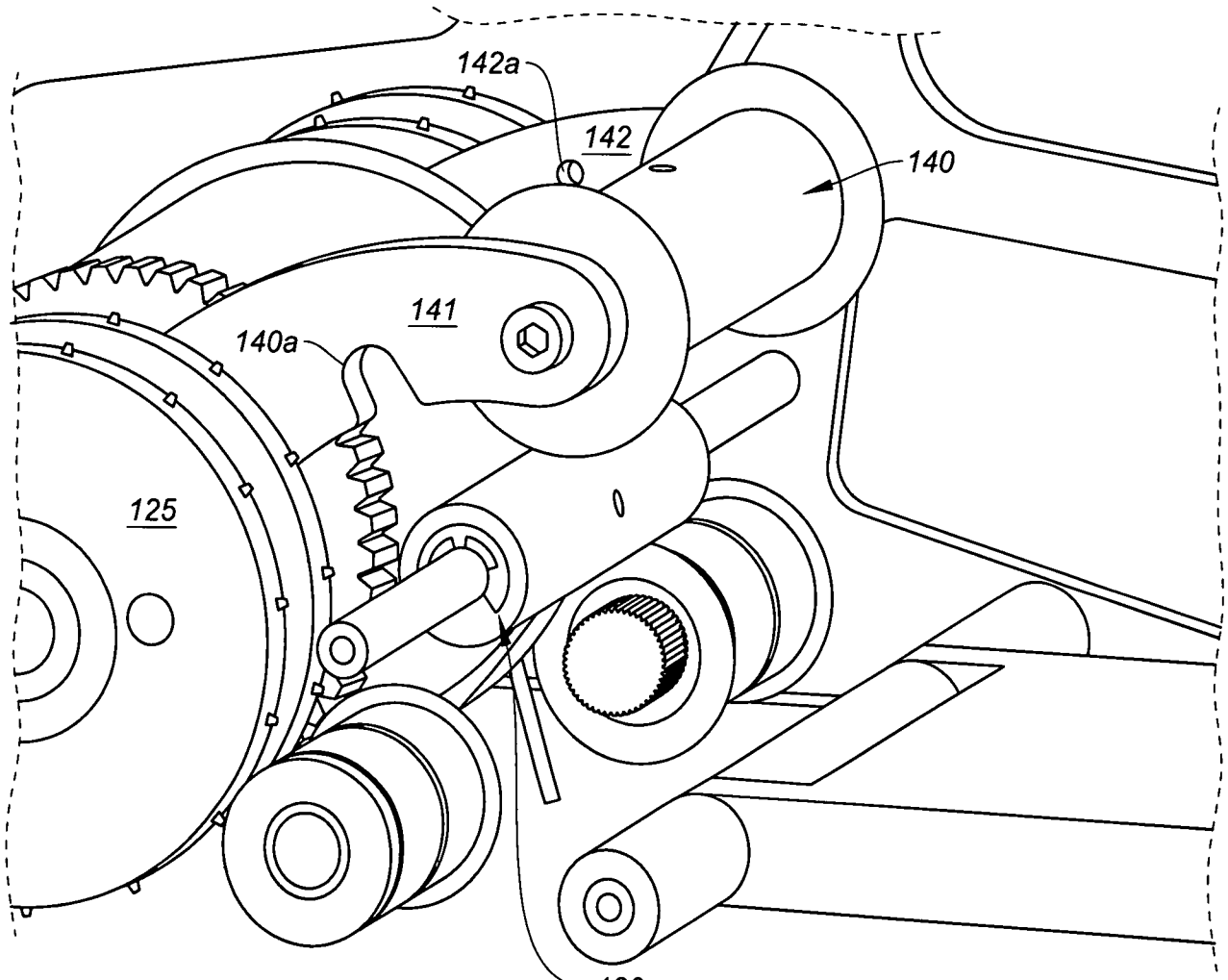
FIG. 7B illustrates the improved mounting and positioning of the nip and tension rollers.

FIG. 7B is a perspective view showing how the new tension roller 140 is supported by dual support arms 141 and 142. Each support arm 141 and 142 is recessed at 141*a* and 142*a* to allow tension roller 140 to move downwardly toward fixed nip roller 130. This improved support has eliminated the slippage problem caused by the cantilevered support arm 13*a* shown in FIG. 7A.

Figure 8A:
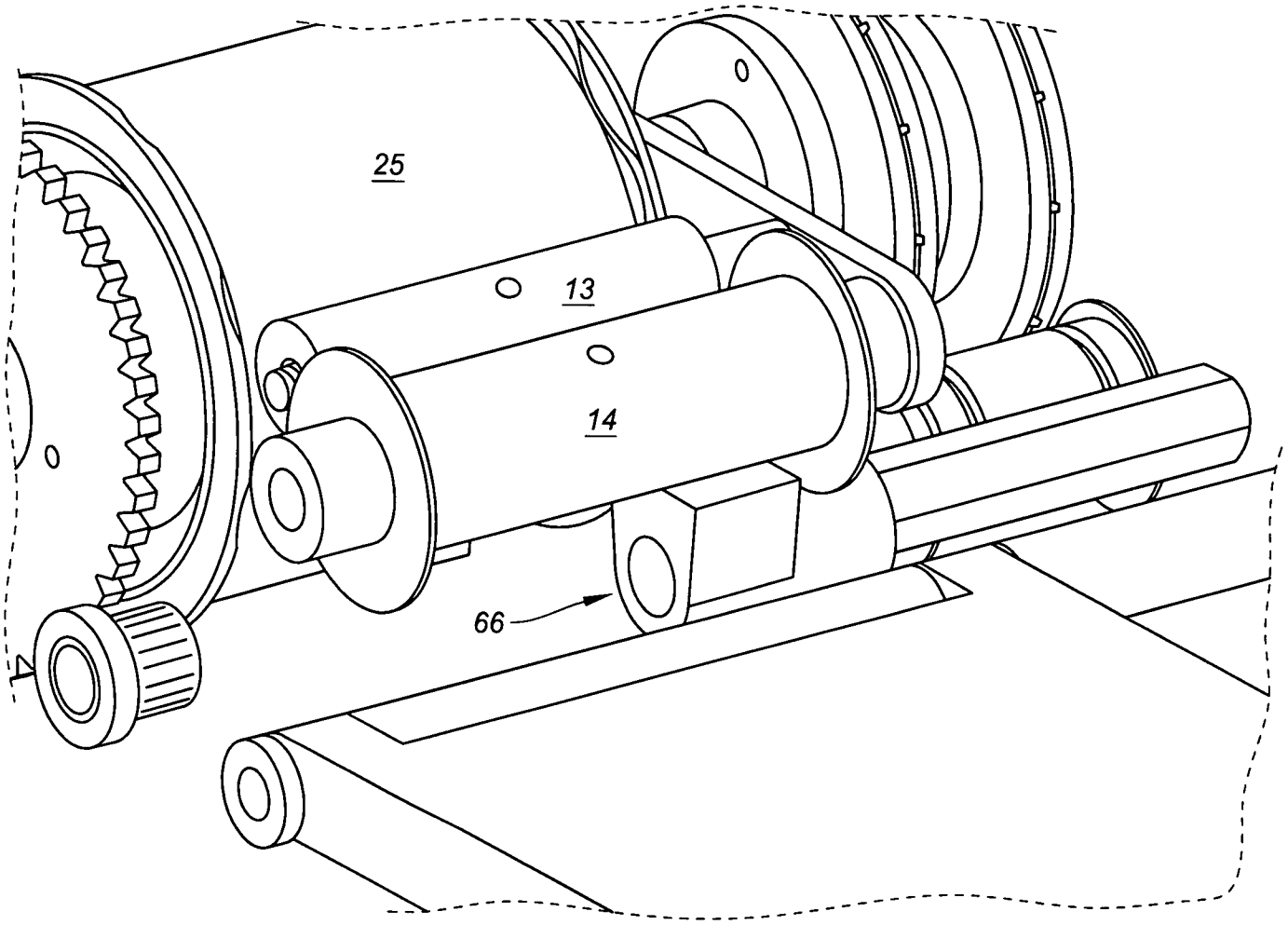
FIG. 8A (Prior Art)
FIG. 8A illustrates the prior art tension roller stop.

FIG. 8A illustrates a further problem with using the larger and heavier labels with the prior art design. The prior art used a roller stop 66 to limit the downward travel of tension roller 14. However, with the larger and heavier label strip, the tension roller moves further downwardly and the label strip (not shown) is pinched by stop 66, causing slippage of the label strip.

Figure 8B:
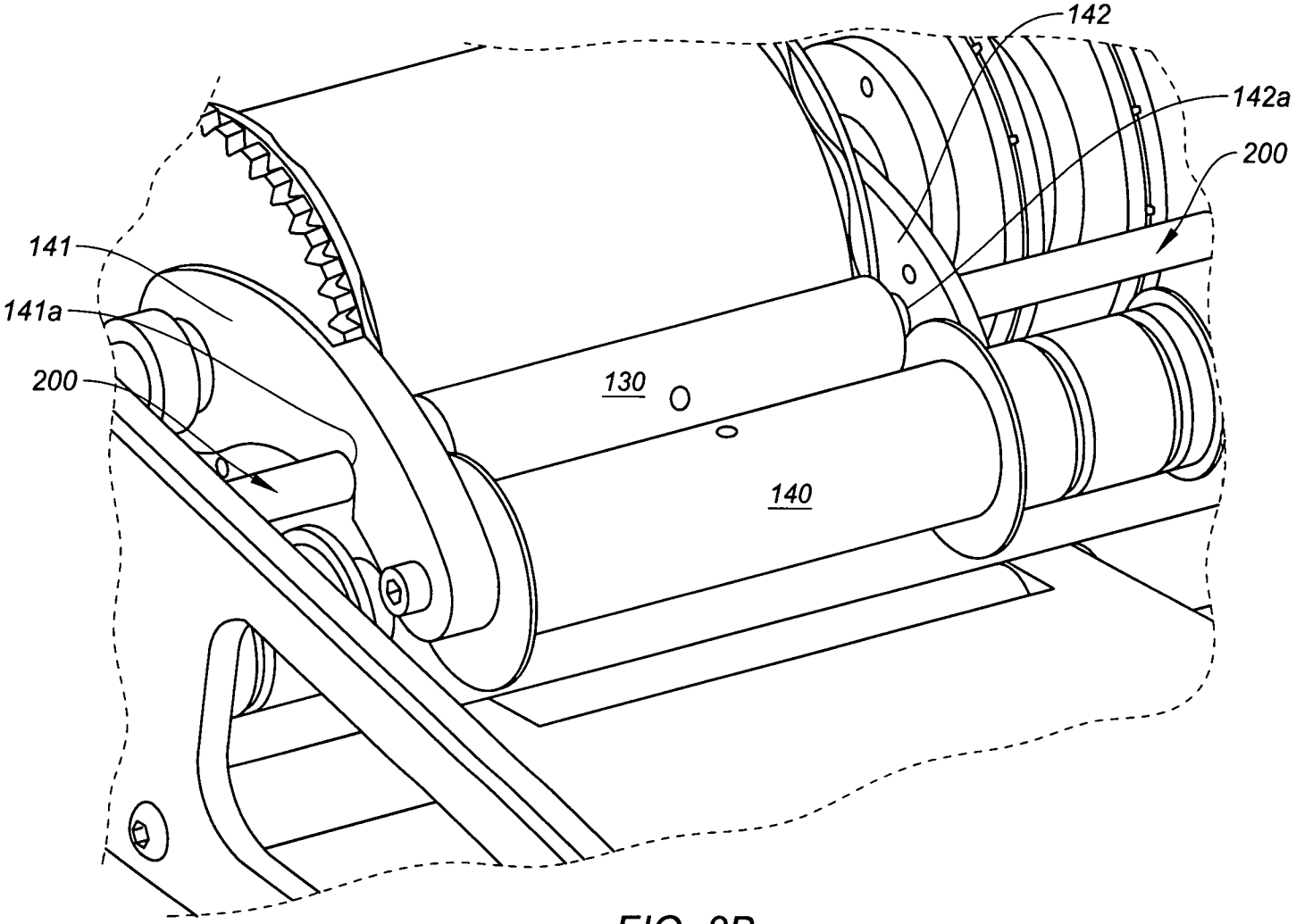
FIG. 8B illustrates the improved tension roller stop for use with a much heavier label strip.

FIG. 8B shows improved stop bar 200, which also serves as a support rod for nip roller 130. Stop bar 200 engages the recesses 141*a* and 142*a* of support arms 141 and 142 of tension roller 140, and limits the downward travel of tension roller 140 to avoid any pinching of the label strip (not shown in FIG. 9B) and thereby prevents this cause of slippage.

Figure 9:
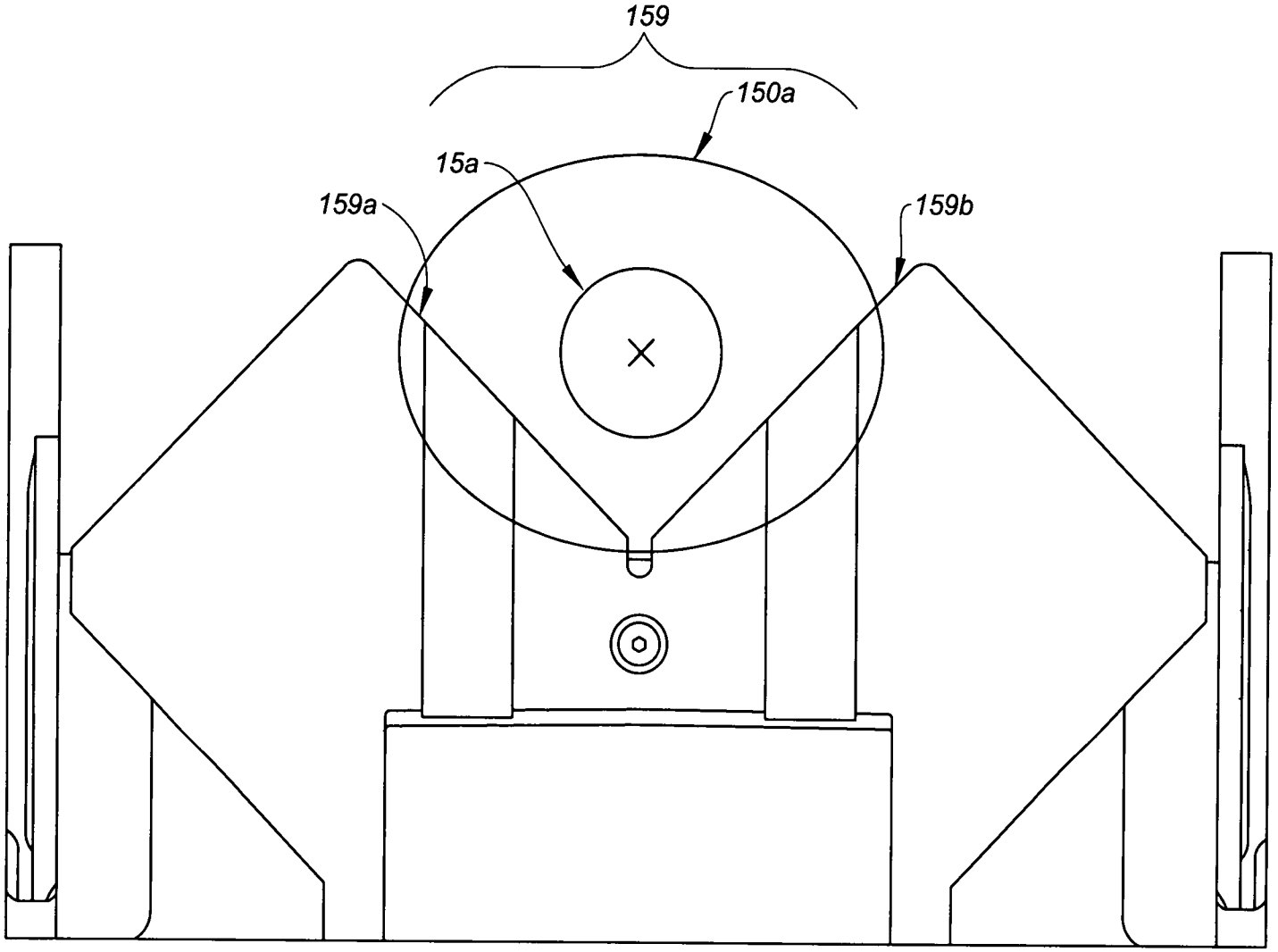
FIG. 9 illustrates the size difference between prior art small produce labels and the much larger labels used for large produce items.

FIG. 9 illustrates the relative sizes of a prior art single label 15a compared to a larger, heavier preferred label 150a having a width of 81 mm used in the present invention. The label transfer point 159 is shown as the region between V-shaped label stripping edges 159*a* and 159*b*.

Figure 10A:
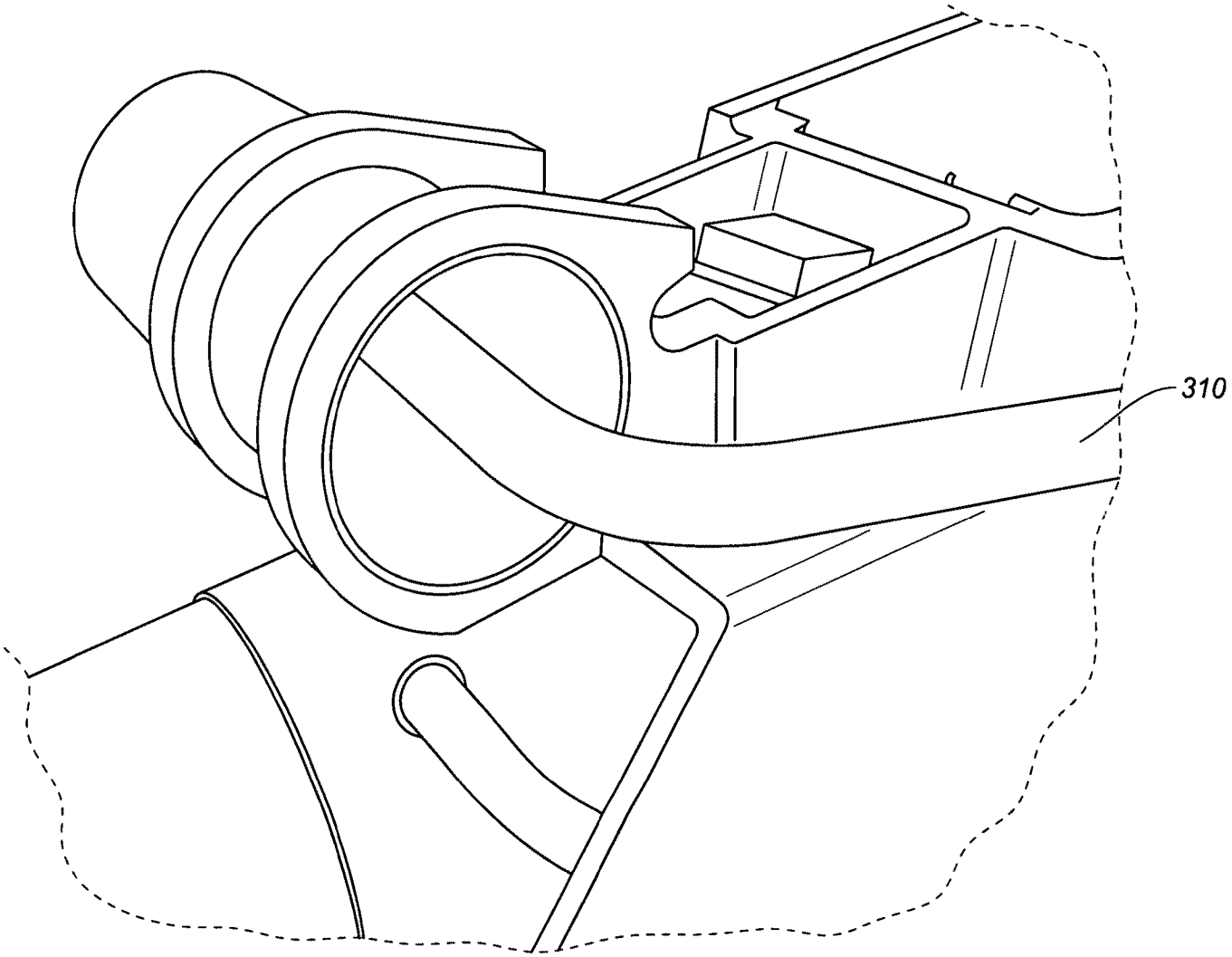
FIG. 10A (Prior Art)
FIGS. 10A-10B illustrate the problem using the prior art waste eliminator with the much heavier and larger label strip.
Figure 10B:
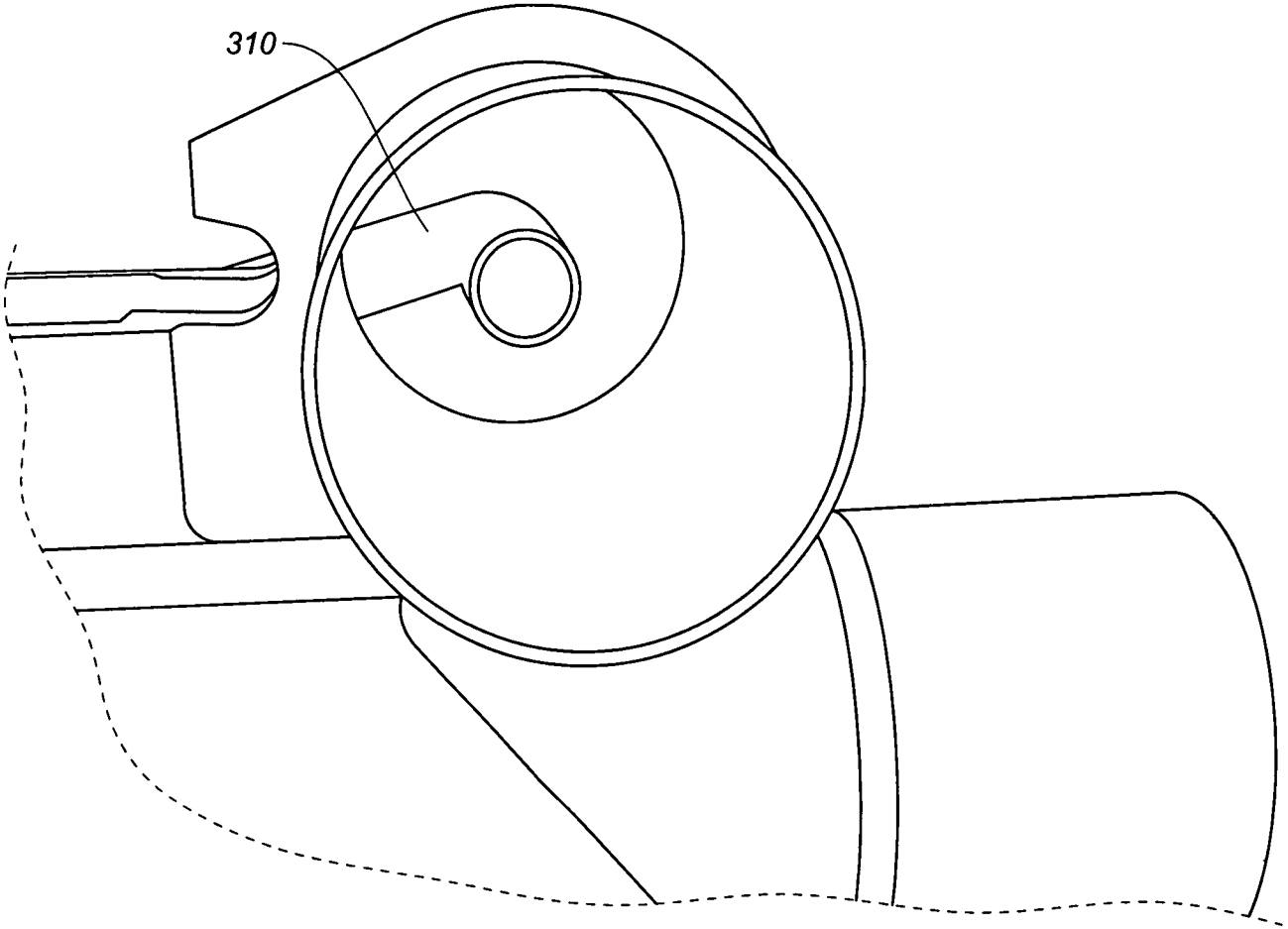
FIG. 10B (Prior Art)
Figure 10C:
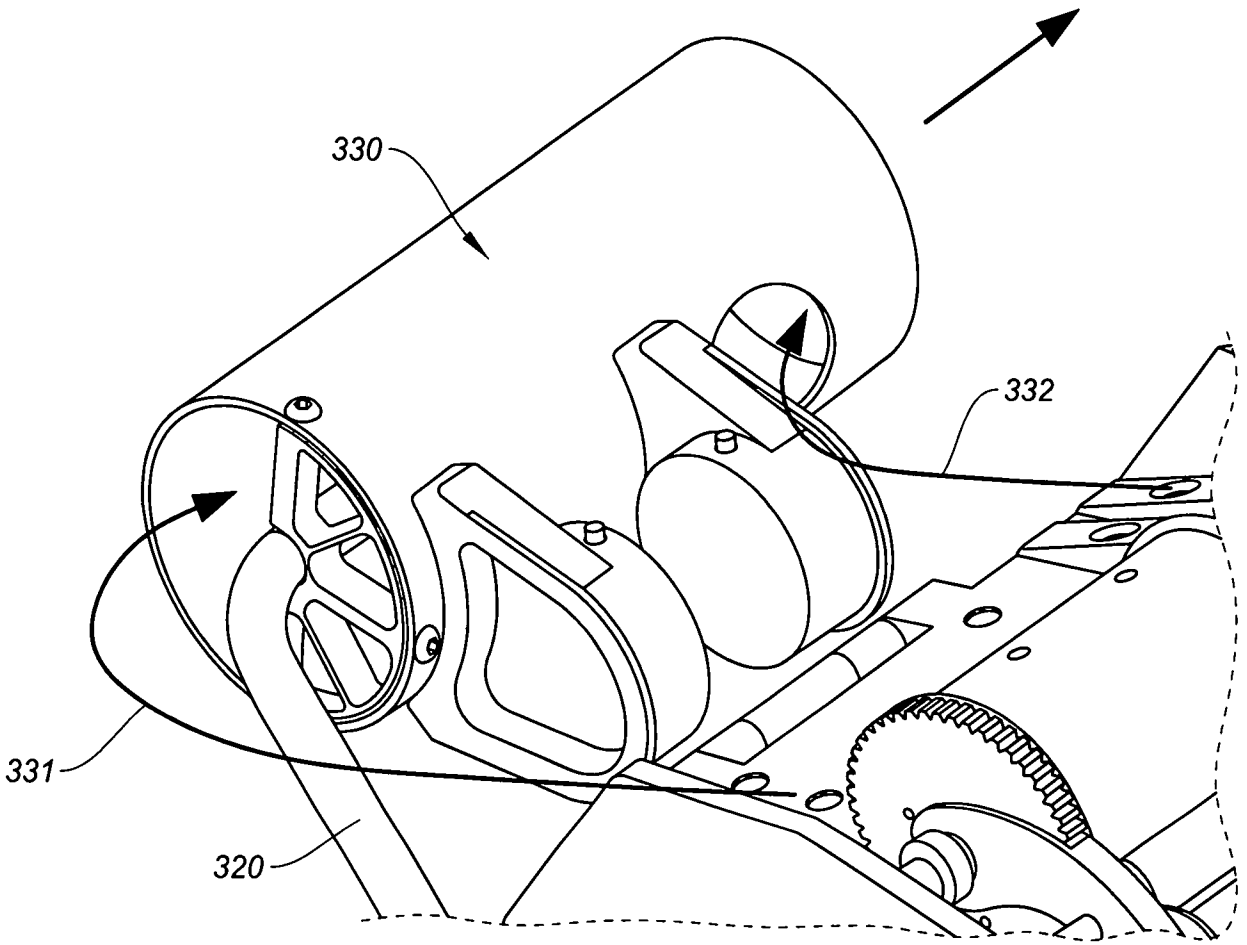
FIGS. 10C-10D illustrate the improved, dual stream waste eliminator.
Figure 10D:
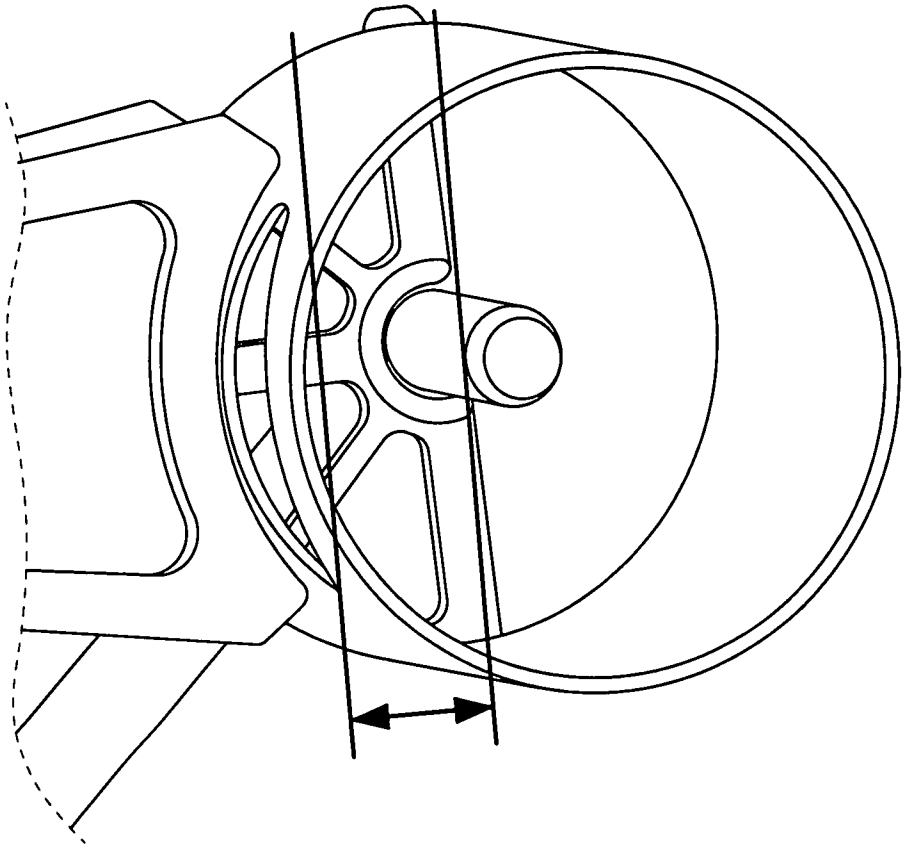

FIGS. 10A-10D illustrate a problem with dealing with significantly wider waste tape and the solution to the problem. FIGS. 10A and 10B illustrate the single prior art tube 310 through which the two streams of waste tape (not shown) flow. When the significantly wider, dual streams enter prior art tube 310, the two streams of waste tape would become intermixed and tangled. As shown in FIGS. 10C and 10D, two waste stream separator 330 mounted to enlarged tube 320, keeps the two waste tape streams 331 and 332 separated.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments suited to the particular use contemplated.

We claim:

1. An apparatus used to apply labels of a label strip carried on a cassette to items, said apparatus comprising:

a label applicator including;

a plurality of expandable bellows;

an indexable rotary head carrying said expandable bellows thereon;

a label transfer point above said indexable rotary head, and a cassette supporter above said label transfer point and configured to support said cassette thereon; and label strip deflection means above said label transfer point and configured to prevent said label strip from overrunning toward said label transfer point, wherein said label strip deflection means is between said label transfer point and said cassette supporter, and wherein said label strip deflection means is a fixed plate inclined upwardly in a direction away from said label transfer point.

2. The apparatus of claim 1, further comprising a label strip drive means configured to propel and transfer said label strip at operational speeds greater than 30 meters per minute.

3. The apparatus of claim 1, further comprising a label strip drive means configured to transport said label strip from said cassette to said label transfer point wherein said label strip deflection means is positioned above a pathway of said label strip and laterally between said label strip drive means and said label transfer point.

4. The apparatus of claim 1, further comprising a label strip drive means configured to transport said label strip from said cassette to said label transfer point, wherein said label strip drive means comprises a driven scallop wheel and nip roller and said nip roller is positioned in a fixed relationship with said driven scallop wheel to achieve an arc of constant frictional engagement between said driven scallop wheel and said label strip of at least 270 degrees.

5. The apparatus of claim 1, further comprising:

a label strip drive means including:

a driven scallop wheel;

a tension roller;

first and second support arms interconnecting said driven scallop wheel and said tension roller; and a nip roller having a nip roller axle, wherein said first and second support arms are movable from an uppermost position to a lowermost position, where said first and second support arms abut said nip roller axle.

6. The apparatus of claim 5, wherein each of said first and second support arms is formed with a recess, wherein said nip roller axle is received in said recesses when said first and second support arms are at the lowermost position.

7. The apparatus of claim 1, further comprising a label strip drive means including:

a driven scallop wheel rotatable about a first axis;

a nip roller rotatable about a second axis; and a tension roller rotatable about a third axis and movable from an uppermost position, where said third axis is above said first axis, to a lowermost position, where said third axis is above said second axis.

8. The apparatus of claim 1, wherein said label strip deflection means has a first portion mounted on said label applicator and a second portion that extends from said first portion.

9. The apparatus of claim 8, wherein said second portion inclines away from said label transfer point.

10. The apparatus of claim 8, wherein said label strip deflection means is generally L shape.

11. The apparatus of claim 8, wherein said label applicator further includes:

a frame;

label stripping edges that are mounted on said frame and that define said label transfer point; and a support mounted on said frame and above said label stripping edges, wherein said first portion of said label strip deflection means is mounted on said support.

* * * * *